US010348019B1

(12) United States Patent
Hocevar et al.

(10) Patent No.: US 10,348,019 B1
(45) Date of Patent: Jul. 9, 2019

(54) CONNECTOR ASSEMBLY WITH LOCKING FEATURE

(71) Applicant: Delphi Technologies, LLC, Troy, MI (US)

(72) Inventors: Erika M. Hocevar, Southington, OH (US); Bart N. Caldwell, West Farmington, OH (US); Christopher A. Margrave, Ashtabula, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/946,314

(22) Filed: Apr. 5, 2018

(51) Int. Cl.
*H01R 13/422* (2006.01)
*H01R 13/436* (2006.01)
*H01R 13/50* (2006.01)

(52) U.S. Cl.
CPC ..... *H01R 13/4223* (2013.01); *H01R 13/4361* (2013.01); *H01R 13/4226* (2013.01); *H01R 13/4362* (2013.01); *H01R 13/501* (2013.01)

(58) Field of Classification Search
CPC ..... H01R 13/4362; H01R 13/4223; H01R 13/4226; H01R 13/501
USPC ..... 439/752, 595, 596
See application file for complete search history.

(56) References Cited

U.S. PATENT DOCUMENTS 5,733,144 A * 3/1998 Tsuji ..... H01R 13/4223 439/595
6,244,910 B1 * 6/2001 Grubbs ..... H01R 13/113 439/595
2004/0235365 A1 * 11/2004 Fujita ..... H01R 13/516 439/752

* cited by examiner

*Primary Examiner* — Abdullah A Riyami
*Assistant Examiner* — Justin M Kratt
(74) *Attorney, Agent, or Firm* — Joseph Victor Bonadies

(57) ABSTRACT

A connector assembly includes a connector-body having electrical-terminals. The electrical-terminals are inserted into cavities defined by the connector-body through apertures defined in a rear-face of the connector-body. The connector-body includes a lock feature configured to releasably lock the electrical-terminals within the cavities. The lock feature has a planar-member with a first-end and a second-end. The first-end defines a flex-lock feature. The second-end is attached by a hinge to a leading-edge of the outer-surface of the connector-body proximate the front-face. The flex-lock feature defines a hook-side and a wall-side disposed within a slot defined by the connector-body. The hook-side is configured to releasably engage a locking-shelf partially enclosing the slot. The wall-side engages the electrical-terminals when the hook-side engages the locking-shelf. When a removal-force is applied to the electrical-terminals, the removal-force is transferred through the hook-side to the locking-shelf, thereby inhibiting removal of the electrical-terminals from the cavities.

20 Claims, 3 Drawing Sheets

CONNECTOR ASSEMBLY WITH LOCKING FEATURE

TECHNICAL FIELD OF INVENTION

This disclosure generally relates to an electrical connector assembly, and more particularly relates to an electrical connector assembly with a locking feature.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1A:
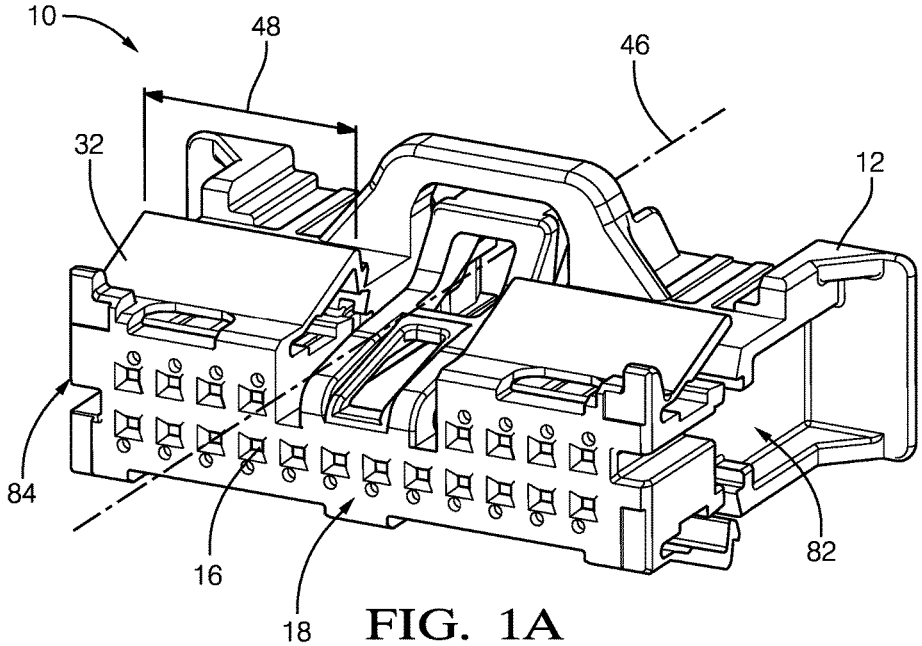
FIG. 1A is a perspective view of a connector assembly in accordance with one embodiment.
Figure 1B:
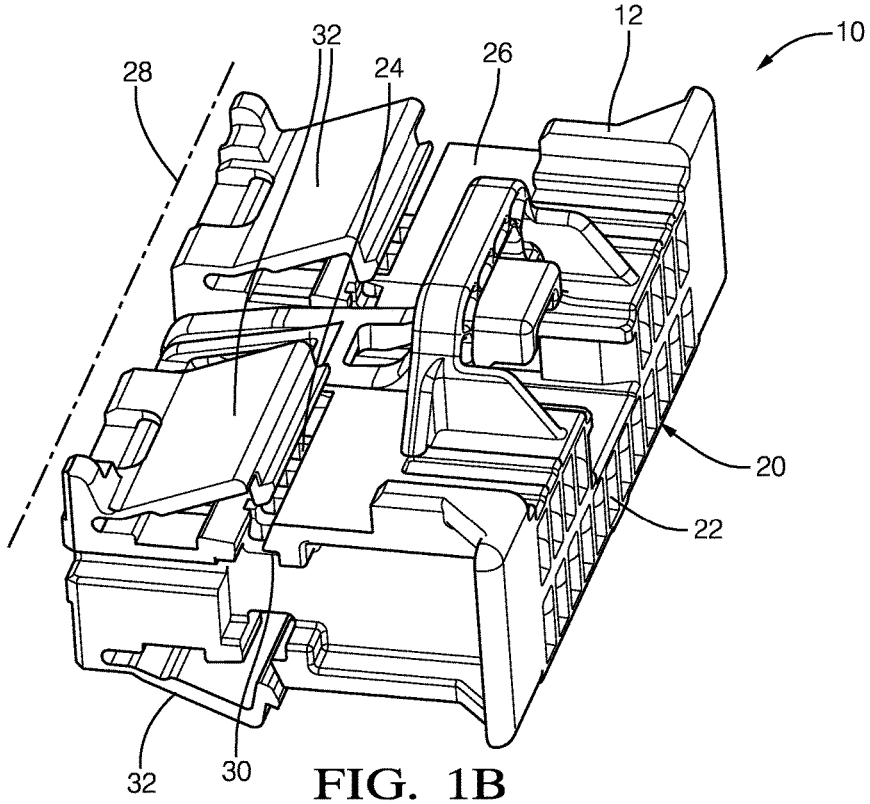
FIG. 1B is another perspective view of the connector assembly of FIG. 1A in accordance with one embodiment.

FIGS. 1A-1B are perspective views illustrating a connector assembly 10, hereafter referred to as the assembly 10. The assembly 10 includes a connector-body 12 having electrical-terminals 14 (see FIG. 2) disposed within cavities 16 defined by the connector-body 12. The electrical-terminals 14 are configured to mate with corresponding electrical-terminals of a mating-connector (not shown). The electrical-terminals 14 are formed of an electrically conductive material, such as a copper-based alloy that may also include a coating of another conductive material (e.g. tin-based, silver-based coating). The electrical-terminals 14 are configured to be attached to a wire cable (not shown) that may be a component of a wiring-harness of a vehicle. The connector-body 12 is formed of a polymeric dielectric material. The polymeric dielectric material may be any polymeric dielectric material capable of electrically isolating portions of the electrical-terminals 14, and is preferably a polyamide (NYLON) material. Preferably, the connector-body 12 is formed of a dielectric polymeric material comprising at least 33% glass-fill. The connector-body 12 defines a front-face 18 and a rear-face 20, wherein the electrical-terminals 14 are inserted into the cavities 16 through terminal-apertures 22 defined by the rear-face 20. The connector-body 12 defines a slot 24 in an outer-surface 26 extending along a lateral-axis 28 of the connector-body 12. The slot 24 is partially enclosed by a locking-shelf 30 extending in a longitudinal-direction. The locking-shelf 30 is formed integral to the connector-body 12 and overlays a portion of the slot 24 and will be described in more detail below.

Figure 2:
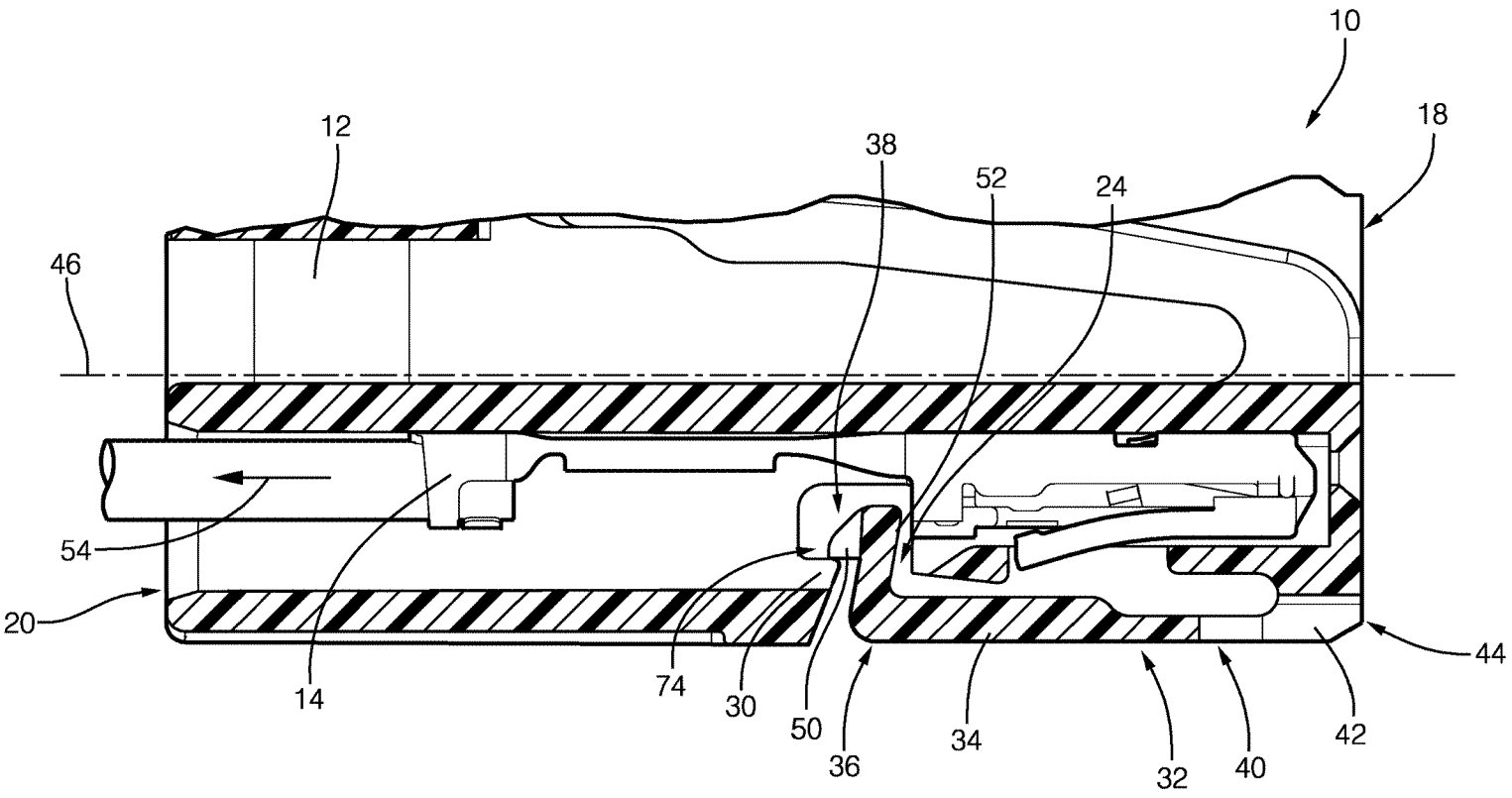
FIG. 2 is a section-view of a segment of the connector assembly of FIGS. 1A-1B in accordance with one embodiment.

FIG. 2 is a section-view of the assembly 10 illustrating the electrical-terminal 14 installed in a lower cavity 16 as would be located near a centerline of the assembly 10. The connector-body 12 includes a lock feature 32 formed integral to the connector-body 12 configured to releasably lock the electrical-terminals 14 within the cavities 16. The connector-body 12 may include a plurality of lock features 32 distributed about the outer-surface 26, as illustrated in FIGS. 1A-1B. That is, the lock features 32 may be located on a top-side and/or a bottom-side of the connector-body 12. The lock feature 32 has a planar-member 34 having a first-end 36 defining a flex-lock feature 38, and second-end 40 attached by a hinge 42 to a leading-edge 44 of the outer-surface 26 of the connector-body 12 proximate the front-face 18. The planar-member 34 extends from the hinge 42 along a longitudinal-axis 46 of the connector-body 12, orthogonal to the lateral-axis 28, and overlays the outer-surface 26 terminating at the flex-lock feature 38. The second-end 40 of the planar-member 34 may be attached by at least one hinge 42, or may be attached by a plurality of hinges 42 depending on a dimension of the connector-body 12.

The flex-lock feature 38 extends along a width 48 (see FIG. 1A) of the planar-member 34 parallel to the lateral-axis 28 and is disposed within the slot 24, as illustrated in FIG. 2. The flex-lock feature 38 defines a hook-side 50 and a wall-side 52, with the hook-side 50 oriented toward the rear-face 20 and the wall-side 52 oriented toward the front-face 18 of the connector-body 12. That is, the hook-side 50 is "rear-facing" and the wall-side 52 is "front-facing" relative to the connector-body 12. An advantage of the "front-facing" orientation of the wall-side 52 will become apparent upon further reading of the description below. The hook-side 50 is configured to releasably engage the locking-shelf 30, as is illustrated in FIG. 2 where the hook-side 50 overlaps the locking-shelf 30 within the slot 24. The wall-side 52 is configured to engage a portion of the electrical-terminals 14 that are exposed by the slot 24 when the hook-side 50 engages the locking-shelf 30. The flex-lock feature 38 protrudes into a notch formed in the electrical-terminal 14 that is aligned with the slot 24 and creates a positive stop for the electrical-terminal 14 along the longitudinal-axis 46. When a removal-force 54 is applied to the electrical-terminals 14, as may occur when the wire-cable attached to the electrical-terminal 14 is pulled along the longitudinal-axis 46, the electrical-terminal 14 contacts the wall-side 52 and the removal-force 54 is transferred through the hook-side 50 to the locking-shelf 30, thereby inhibiting removal of the electrical-terminals 14 from the cavities 16. That is, when an attempt is made, either intentionally or unintentionally, to pull the electrical-terminal 14 out from the connector-body 12 by the wire-cable, the flex-lock feature 38 resists the removal-force 54 and more forcefully engages the locking-shelf 30. It will be appreciated that the flex-lock feature 38 will resist the removal-force 54 applied to a connector-end of the electrical-terminal 14, as may occur when the corresponding electrical-terminals of the mating-connector are inserted at the front-face 18. This forceful engagement of the locking-shelf 30 is enabled by the "forward-facing" orientation of the wall-side 52 of the flex-lock feature 38. It will also be appreciated that the flex-lock feature 38 cannot be unlocked by the removal-force 54 due to the engagement of the hook-side 50 with the locking-shelf 30. The planar-member 34 is also beneficial because the planar-member 34 isolates (i.e. insulates, covers, protects, etc.) the electrical-terminals 14 within the cavities 16 when the hook-side 50 of the flex-lock feature 38 engages the locking-shelf 30.

Figure 3:
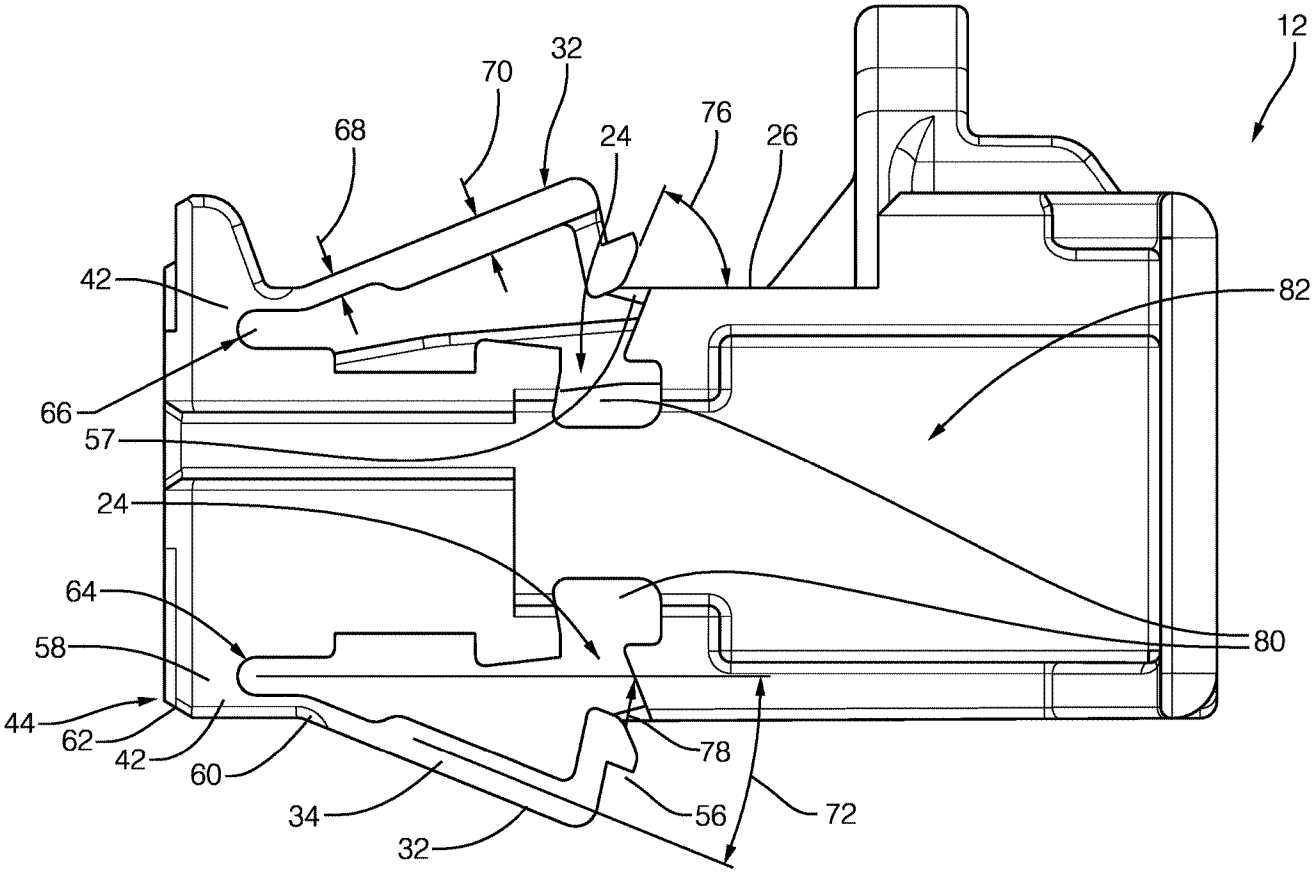
FIG. 3 is a side-view of the connector-body of the connector assembly of FIGS. 1A-2 in accordance with one embodiment.

FIG. 3 illustrates a side-view of the connector-body 12 with the electrical-terminals 14 removed and the lock features 32 in an open-position 56. The open-position 56 is characteristic of the connector-body 12 in an as-manufactured state and would enable the installation of the electrical-terminals 14. Note the presence of tethers 57 bridging the flex-lock features 38 to the outer-surface 26. The tethers 57 are frangible and are fractured upon closing the lock-features 32. The hinge 42 defines a base 58 and a web 60. The base 58 is attached to the leading-edge 44 of the outer-surface 26, as previously described, and the web 60 extends from a top 62 of the base 58 to the planar-member 34. That is, the planar-member 34 is connected to the base 58 by the web 60. The base 58 defines a rear-facing surface characterized as having a curved-transition 64 between the outer-surface 26 of the connector-body 12 and the web 60. The curved-transition 64 is characterized as having a radius 66 in a range of 0.3 mm to 0.35 mm. The web 60 has a web-thickness 68 in a range of 0.25 mm to 0.65 mm, wherein the planar-member 34 has a planar-member-thickness 70 in a range of 0.5 mm to 1.0 mm. The combination of the curved-transition 64 and the web-thickness 68 of the hinge 42 enables a swing of the planar-member 34 through a swing-angle 72 of up to 45-degrees when the lock feature 32 is moved from the open-position 56 to a locked-position 74 (see FIG. 2). This geometry of the hinge 42 has the technical benefit of distributing a principal-stress within the hinge 42 such that the principal-stress does not exceed a yield-strength of the at least 33% glass-filled polymeric dielectric material. Experimentation by the inventors has discovered that the lock feature 32 may achieve in excess of ten locking/unlocking cycles without a failure of the hinge 42, which indicates up to a five-fold increase in the cyclic durability of the at least 33% glass-filled polymeric dielectric material.

Referring back to FIG. 3, the flex-lock feature 38 defines a lead-angle 76 on the hook-side 50 configured to guide the flex-lock feature 38 into the slot 24 to the locked-position 74 when the lock feature 32 is moved from the open-position 56 to the locked-position 74. The lead-angle 76 is determined based on a targeted engagement-force 78 exerted by the hook-side 50 on the locking-shelf 30 when the lead-angle 76 engages the locking-shelf 30. The engagement-force 78 is preferably in a range of 30 Newtons to 45 Newtons.

Referring again to FIG. 3, the slot 24 defines apertures 80 located on a first-side 82 and a second-side 84 (see FIG. 1A) of the connector-body 12 that are configured to receive a tool (e.g. a small flat-blade screw driver, or similar) to release the hook-side 50 from the locking-shelf 30 when the lock feature 32 is in the locked-position 74. The apertures 80 are beneficial for servicing the assembly 10 after installation of the electrical-terminals 14.

Accordingly, a connector assembly 10 is provided. The assembly 10 is an improvement over prior art connector assemblies because the assembly 10 has the lock feature 32 that inhibits the removal of the electrical-terminals 14 from the cavities 16 and resists the unlocking when exposed to the removal-force 54.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector assembly, comprising:

a connector-body having electrical-terminals disposed within cavities defined by the connector-body, said electrical-terminals configured to mate with corresponding electrical-terminals of a mating-connector, said connector-body defining a front-face and a rear-face wherein the electrical-terminals are inserted into the cavities through terminal-apertures defined by the rear-face, said connector-body defining a slot in an outer-surface extending along a lateral-axis of the connector-body, said slot partially enclosed by a locking-shelf extending in a longitudinal-direction, said connector-body including a lock feature formed integral to the connector-body configured to releasably lock the electrical-terminals within the cavities, said lock feature having a planar-member having a first-end defining a flex-lock feature and second-end attached by a hinge to a leading-edge of the outer-surface of the connector-body proximate the front-face, said planar-member extending from the hinge along a longitudinal-axis of the connector-body orthogonal to the lateral-axis overlaying the outer-surface and terminating at the flex-lock feature, said flex-lock feature extending along a width of the planar-member parallel to the lateral-axis and disposed within the slot, said flex-lock feature defining a hook-side and a wall-side, said hook-side oriented toward the rear-face and said wall-side oriented toward the front-face, said hook-side configured to releasably engage the locking-shelf, said wall-side configured to engage a portion of the electrical-terminals when the hook-side engages the locking-shelf, wherein when a removal-force is applied to the electrical-terminals, the removal-force is transferred through the hook-side to the locking-shelf, thereby inhibiting removal of the electrical-terminals from the cavities.

2. The connector assembly in accordance with claim 1, wherein the second-end of the planar-member includes a plurality of hinges.

3. The connector assembly in accordance with claim 1, wherein the hinge defines a base and a web, said base attached to the leading-edge of the outer-surface, said web extending from a top of the base to the planar-member, said base defines a rear-facing surface characterized as having a curved-transition between the outer-surface of the connector-body and the web.

4. The connector assembly in accordance with claim 3, wherein the curved-transition is characterized as having a radius in a range of 0.3 mm to 0.35 mm.

5. The connector assembly in accordance with claim 3, wherein the web has a web-thickness in a range of 0.25 mm to 0.65 mm.

6. The connector assembly in accordance with claim 3, wherein the planar-member has a planar-member-thickness in a range of 0.5 mm to 1.0 mm.

7. The connector assembly in accordance with claim 1, wherein the flex-lock feature defines a lead-angle on the hook-side configured to guide the flex-lock feature into the slot to a locked-position when the lock feature is moved from an open-position to the locked-position.

8. The connector assembly in accordance with claim 7, wherein the hook-side exerts an engagement-force on the locking-shelf in a range of 30 Newtons to 45 Newtons when the lead-angle engages the locking-shelf.

9. The connector assembly in accordance with claim 1, wherein the planar-member isolates the electrical-terminals within the cavities when the hook-side of the flex-lock feature engages the locking-shelf.

10. The connector assembly in accordance with claim 1, wherein the slot defines apertures located on a first-side and a second-side of the connector-body, said apertures configured to receive a tool to release the hook-side from the locking-shelf when the lock feature is in a locked-position.

11. The connector assembly in accordance with claim 1, wherein the connector-body is formed of a dielectric polymeric material comprising at least 33% glass-fill.

12. The connector assembly in accordance with claim 1, wherein the hinge enables a swing of the planar-member through a swing-angle of up to 45-degrees when the lock feature is moved from an open-position to a locked-position.

13. A connector, comprising:

a connector-body configured to receive electrical-terminals disposed within cavities defined by the connector-body, said connector-body defining a front-face and a rear-face, said rear-face defining terminal-apertures configured to insertably receive the electrical-terminals, said connector-body defining a slot in an outer-surface extending along a lateral-axis of the connector-body, said slot partially enclosed by a locking-shelf extending in a longitudinal-direction, said connector-body including a lock feature formed integral to the connector-body configured to releasably lock the electrical-terminals within the cavities, said lock feature having a planar-member having a first-end defining a flex-lock feature and second-end attached by at least one hinge to a leading-edge of the outer-surface of the connector-body proximate the front-face, said planar-member extending from the at least one hinge along a longitudinal-axis of the connector-body orthogonal to the lateral-axis overlaying the outer-surface and terminating at the flex-lock feature, said flex-lock feature extending along a width of the planar-member parallel to the lateral-axis and disposed within the slot, said flex-lock feature defining a hook-side and a wall-side, said hook-side oriented toward the rear-face and said wall-side oriented toward the front-face, said hook-side configured to releasably engage the locking-shelf, said wall-side configured to engage a portion of the electrical-terminals when the hook-side engages the locking-shelf, wherein when a removal-force is applied to the electrical-terminals, the removal-force is transferred through the hook-side to the locking-shelf, thereby inhibiting removal of the electrical-terminals from the cavities.

14. The connector in accordance with claim 13, wherein the at least one hinge defines a base and a web, said base attached to of the outer-surface, said web extending from a top of the base to the planar-member, said base defines a rear-facing surface characterized as having a curved-transition between the outer-surface of the connector-body and the web.

15. The connector in accordance with claim 13, wherein the flex-lock feature defines a lead-angle on the hook-side configured to guide the flex-lock feature into the slot to a locked-position when the lock feature is moved from an open-position to the locked-position.

16. The connector in accordance with claim 15, wherein the hook-side exerts an engagement-force on the locking-shelf in a range of 30 Newtons to 45 Newtons when the lead-angle engages the locking-shelf.

17. The connector in accordance with claim 13, wherein the planar-member isolates the electrical-terminals within the cavities when the hook-side of the flex-lock feature engages the locking-shelf.

18. The connector in accordance with claim 13, wherein the slot defines apertures located on a first-side and a second-side of the connector-body, said apertures configured to receive a tool to release the hook-side from the locking-shelf when the lock feature is in a locked-position.

19. The connector in accordance with claim 13, wherein the connector-body is formed of a dielectric polymeric material comprising at least 33% glass-fill.

20. The connector in accordance with claim 13, wherein the at least one hinge enables a swing of the planar-member through a swing-angle of up to 45-degrees when the lock feature is moved from an open-position to a locked-position.

* * * * *